US006000930A

United States Patent [19]

Kelly et al.

[11] Patent Number: 6,000,930

[45] Date of Patent: Dec. 14, 1999

[54] COMBUSTION PROCESS AND BURNER APPARATUS FOR CONTROLLING NOX EMISSIONS

[75] Inventors: John T. Kelly, Los Gatos; Mehdi Namazian, Palo Alto, both of Calif.

[73] Assignee: Altex Technologies Corporation, Santa Clara, Calif.

[21] Appl. No.: 08/854,622

[22] Filed: May 12, 1997

[51] Int. Cl.[6] ..... F23D 3/40

[52] U.S. Cl. ..... 431/7; 431/328; 431/329; 431/285

[58] Field of Search ..... 431/328, 329, 431/7, 285; 60/39.52, 723, 733, 746

[56] References Cited

U.S. PATENT DOCUMENTS

| | | | |
|---|---|---|---|
| 1,896,286 | 2/1933 | Burns et al. | 431/328 |
| 3,425,675 | 2/1969 | Twine | 431/328 |
| 3,847,536 | 11/1974 | Lepage | 431/329 |
| 3,922,136 | 11/1975 | Koch | 431/115 |
| 4,047,877 | 9/1977 | Flanagan | 60/746 |
| 4,496,306 | 1/1985 | Okigami et al. | 431/8 |
| 4,889,481 | 12/1989 | Morris et al. | 431/328 |
| 4,917,599 | 4/1990 | Hasselman | 431/328 |
| 4,926,645 | 5/1990 | Iwai et al. | 60/723 |
| 5,073,106 | 12/1991 | Toyonaga et al. | 431/285 |
| 5,077,089 | 12/1991 | Otto | 427/226 |
| 5,131,838 | 7/1992 | Gensler et al. | 431/177 |
| 5,201,650 | 4/1993 | Johnson | 431/9 |
| 5,214,912 | 6/1993 | Farrauto et al. | 60/646 |
| 5,368,476 | 11/1994 | Sugahara et al. | 431/285 |
| 5,395,235 | 3/1995 | Hung | 60/723 |
| 5,417,566 | 5/1995 | Ishikawa et al. | 431/328 |
| 5,439,372 | 8/1995 | Duret et al. | 431/7 |
| 5,603,905 | 2/1997 | Bartz et al. | 431/328 |
| 5,623,819 | 4/1997 | Bowker et al. | 60/723 |
| 5,626,017 | 5/1997 | Sattelmayer | 60/723 |
| 5,658,139 | 8/1997 | Flanagan et al. | 431/328 |
| 5,667,374 | 9/1997 | Nutcher et al. | 431/328 |

FOREIGN PATENT DOCUMENTS

| | | | |
|---|---|---|---|
| 59-7722 | 1/1984 | Japan | 60/723 |
| 61-195215 | 8/1986 | Japan | 60/723 |
| 62-108912 | 5/1987 | Japan | 431/329 |

*Primary Examiner*—Carroll Dority
*Attorney, Agent, or Firm*—Flehr Hohbach Test Albritton & Herbert LLP

[57] ABSTRACT

A low NOx combustion process and burner apparatus in which a mixture of a primary fuel and air, with the air in excess of the stoichiometric requirement, is passed to a surface burner element. The mixture is distributed over the downstream side of the element where it is combusted in a primary combustion zone. Secondary fuel is mixed with surface combustion products from the primary zone and then combusted in a secondary combustion zone with a portion of excess oxygen from the surface combustion products. In certain embodiments the temperature of surface combustion products is reduced by heat transfer to the surface burner element, and in another embodiment by heat transfer to a screen or other element placed within the primary combustion zone, from which the heat is then extracted to a load, and in another embodiment by mixing the additional fuel or combustion products with cooled furnace gases. In other embodiments the placement of the secondary fuel jets is varied to achieve different combustion results.

25 Claims, 8 Drawing Sheets

COMBUSTION PROCESS AND BURNER APPARATUS FOR CONTROLLING NOX EMISSIONS

BACKGROUND OF THE INVENTION

1. Field of the Invention

This invention relates in general to burners for use in furnaces, boilers, fired heaters and other combustion apparatus for industrial applications. More particularly, the invention relates to low NOx burners and combustion processes for use in such applications.

2. Description of the Related Art

In surface burners, premixed fuel and air burn close to the surface of a porous matrix, fibrous matrix or channeled surface element, with radiative heat loss from the surface reducing the peak flame temperature and NOx. Examples of this type of surface burner are described in Morris U.S. Pat. No. 4,889,481 and Otto U.S. Pat. No. 5,077,089. Burners of this type are limited in their firing rates. As the firing rate is increased, the flame moves away from the surface and this decreases heat transfer back to the surface and thereby decreases radiative heat loss from the flame. Under these conditions, flame temperature and therefore NOx production increase. The limited surface firing rate needed to maintain low NOx limits the application of such burners. Recently, higher firing rate surface burners have been developed, such as described in Duret U.S. Pat. No. 5,439,372, but their NOx emissions are high. To maintain low NOx, these burners must be operated at high excess air, but that in turn reduces their fuel efficiency. The loss in efficiency results because higher excess air leads to higher flue heat losses for a given flue temperature. Secondary fuel injection is also known in the art for low NOx emissions, as for example Johnson U.S. Pat. No. 5,201,650.

The need has therefore been recognized for a low NOx burner and combustion process which obviates the foregoing and other limitations and disadvantages of prior art burners and processes. Despite the various burners and processes in the prior art, there has heretofore not been provided a suitable and attractive solution to these problems.

OBJECTS AND SUMMARY OF THE INVENTION

It is a general object of the present invention to provide a new and improved burner and combustion process for use in furnaces, boilers, fired heaters and other combustion apparatus for industrial applications. More particularly, the invention relates to low NOx burners and combustion processes for use in such applications.

Another object is to provide a burner and combustion process of the type described which reduces NOx and controls other emissions, such as CO and unburned hydrocarbons, while maintaining good efficiency.

The invention in summary provides a combustion process, and burner apparatus, in which a lean mixture of primary fuel and air are passed to a surface element and then the mixture is distributed over the downstream side of the surface element. The mixture is then combusted on the downstream side in a primary combustion zone, producing surface combustion products and heat. Secondary fuel is then mixed with the surface combustion products and the secondary fuel is combusted in a secondary combustion zone with a portion of the excess oxygen from the surface combustion products.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
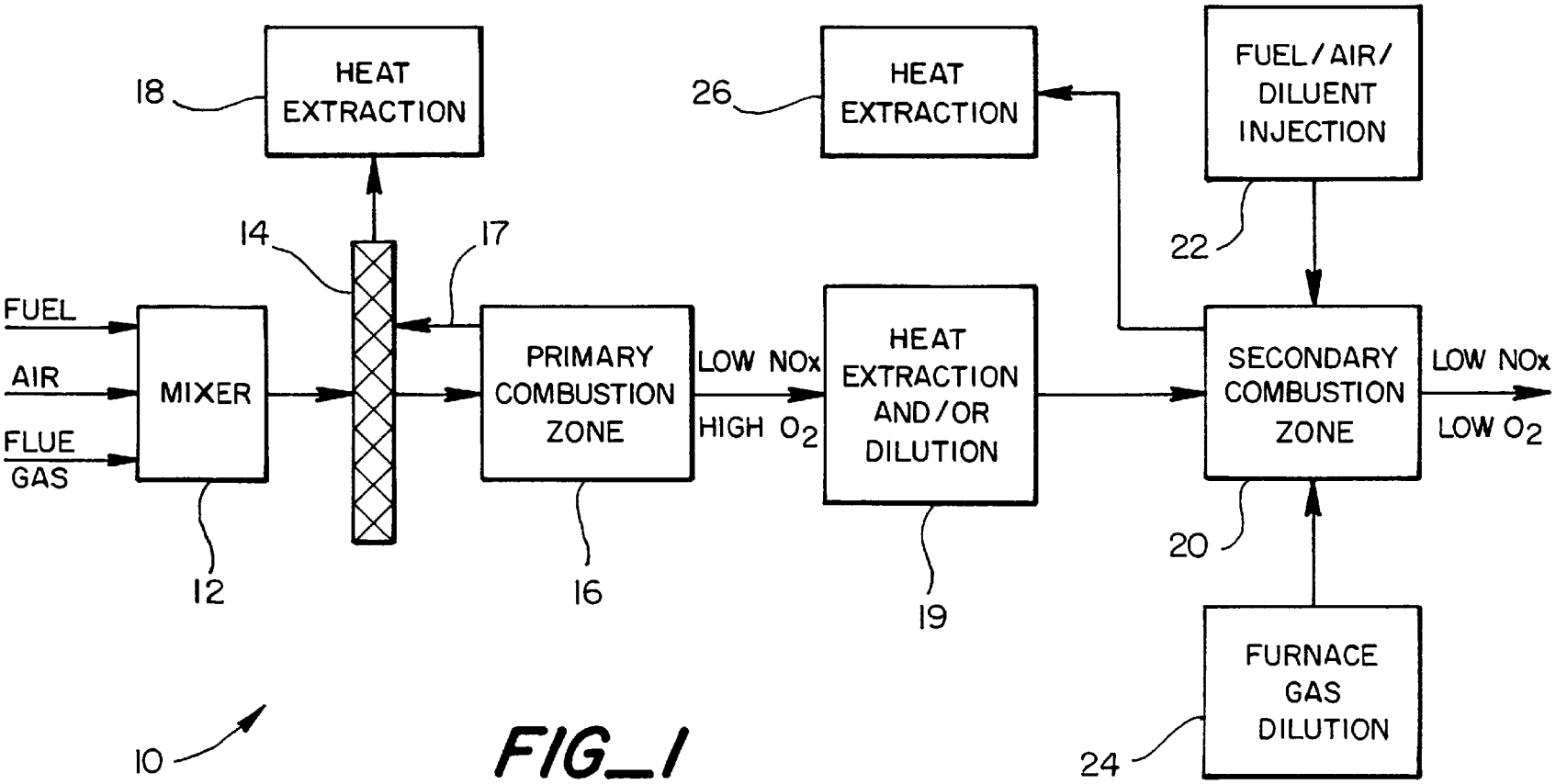
FIG. 1 is a block diagram illustrating the combustion process in accordance with one preferred embodiment of the invention.

FIG. 1 illustrates generally at 10 in block diagram format the general combustion process of a preferred embodiment of the invention. In the first step at 12, primary fuel is mixed with air, such as in a mixer, in excess of the stoichiometric mixture requirement. If the fuel and air are already mixed, this step is not required. In addition, to assist the cooling of the subsequent combustion zone, cooled flue gas could also be added to the fuel and air. In the next step at 14 the mixture is passed to a surface burner element and distributed over the downstream side of the element. In the next step at 16 the mixture is combusted on the downstream side of the burner element in a primary combustion zone. This produces surface combustion products comprising low NOx, low CO, low hydrocarbon emissions and high $O_2$ as well as heat. At 17 a portion of the heat is extracted by transfer to the surface element. The process at step 16 produces surface mediated combustion, which means that the surface element distributes the fuel/air mixture, stabilizes the combustion and extracts some heat from the combustion products for possible transfer to a load. Heat is extracted at step 18 from the surface burner element by transfer to a load.

In step 19 the temperature of the combustion products is reduced by either: a) radiation to the surface burner element, or b) radiation and/or active cooling of screens or other elements (not shown) placed downstream from the surface burner element, or c) radiation from gases and/or dilution with furnace gases from the subsequent secondary combustion at step 20.

In step 20, secondary fuel is added at 22 to the surface combustion products from the primary combustion zone and reacted in a burnout flame in a secondary combustion zone to produce a mixture of low NOx, low CO, low $O_2$ and unburned hydrocarbons.

When it is desired to further lower the temperature of the burnout flame in the secondary combustion zone, relatively cooler furnace gas at 24 can be mixed with the additional fuel prior to final burnout. This step can be carried out by providing additional fuel jets at positions spaced away from the surface burner element and allowing the jets to entrain cooled furnace gas before interacting with the surface combustion products. An alternate method to accomplish the lower burnout flame temperature is carried out by the step at 22 of adding a dilution gas such as furnace gas, steam or the like to the fuel jets or associated flames prior to burnout. To assist in fuel mixing with furnace gas, some air could be mixed at 22 with the fuel jets prior to injection of the additional fuel. Heat is extracted at 26 from the secondary combustion zone and transferred to a load, such as boiler firetubes.

Figure 2:
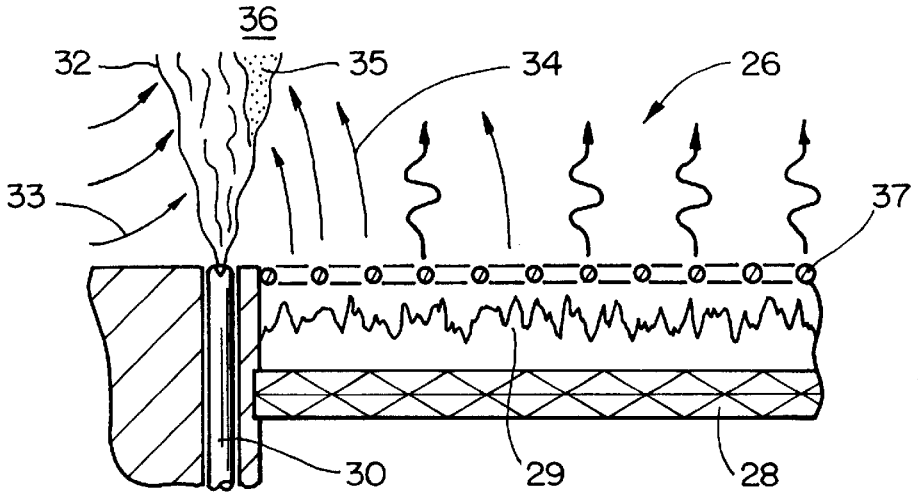
FIG. 2 is an axial sectional view of a burner apparatus in accordance with one embodiment of the invention for carrying out the combustion process of FIG. 1.

FIG. 2 illustrates a system of apparatus 26 for carrying out the general combustion process of FIG. 1. Apparatus 26 comprises a surface burner element 28 which produces surface mediated combustion in a primary combustion zone 29. Burner elements suitable for use in the invention include those known in the industry as porous ceramic, porous metal fiber and ceramic flame impingement. Porous ceramic and porous metal fiber burners are formed with interstitial spaces for passage of premixed fuel and air with combustion taking place close to or within the porous matrix of the downstream surface of the burner element. Examples include the PyroCore™ porous ceramic burner and PyroMat™ porous metal fiber surface burner, both of which are trademarks of Alzeta Corporation. In the PyroCore™ burner, a foam-like porous ceramic material is employed while the PyroMa™ burner uses a metal fiber supplied by the AcoTech company. Metal fiber based burners are capable of greater firing intensity and higher preheat temperatures than porous ceramic burners. Metal fiber type burners are also much more thermal shock resistant, do not experience flashback, and have a relatively long service life. Ceramic flame impingement burners are characterized in having a nozzle which directs premixed fuel and air to impinge on a solid surface. Upon issuing from the nozzle, the mixture is ignited so that the hot combustion products heat the surface. The flame impingement type radiant burner is the most widely used in the industry because of its low cost and good reliability. Typically, the flame impingement burners produce higher NOx than porous burners, have greater heat distribution non-uniformities and have relatively low radiant efficiency (approximately 15%). Also, in some cases their firing intensities are lower than the better porous burners. While the illustrated embodiment shows burner element 28 with a flat configuration, other configurations such as cylindrical shell or the like could be used.

Positioned adjacent the burner element are a plurality of nozzles 30, of which one is shown in FIG. 2, which inject secondary fuel into fuel jets 32 along the downstream side of surface burner element 28. The entrainment of furnace gases into the fuel jets is shown by the arrows 33. Burner gases shown by the arrows 34 are swept into entrainment zone 35 where they mix with the fuel jets. The secondary fuel from the jets reacts in a secondary combustion zone 36 with a portion of the excess air from the surface combustion products of the burner gases.

A perforated screen 37 or tubes, preferably of metal, is mounted in the path of combustion products in the primary combustion zone. The screen is positioned in spaced-apart relationship on the downstream side of the surface burner element. The screen or tubes acts as a heat sink to absorb some of the heat from the primary combustion zone and transfer heat to active cooling or radiate the heat to an external load, not shown, prior to the downstream injection of additional fuel. The external load can comprise, for example, a tube bank through which water, steam, process fluids or the like circulate. The transfer of heat from the screen or tubes supplements the heat transfer provided by surface burner element 28.

Figure 3:
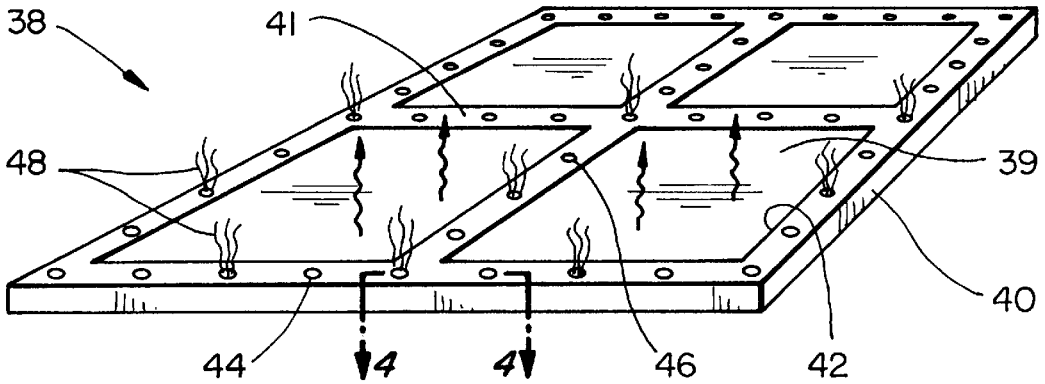
FIG. 3 is a perspective view illustrating burner apparatus in accordance with another embodiment of the invention.
Figure 4:
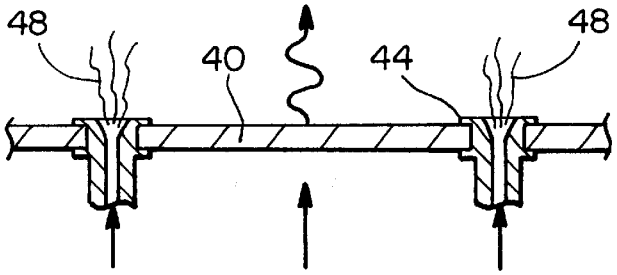
FIG. 4 is a fragmentary sectional view to an enlarged scale taken along the line 4—4 of FIG. 3 showing details of nozzles for fuel jets in the burner.

FIGS. 3 and 4 illustrate another embodiment providing burner apparatus 38. Burner apparatus 38 comprises a plurality of flat surface burner elements 39 (four are shown) mounted in a reticulated grid pattern by means of an outer perimeter frame 40 and inner cross frame 41 which form openings 42 that are sized and shaped so as to support the burner elements. A plurality of nozzles 44, are mounted in spaced-apart relationship around the perimeter frame, and a plurality of nozzles 46 are likewise mounted within the cross frame. The nozzles are connected by a suitable manifold with a pressurized fuel supply, not shown, for directing secondary fuel jets 48 in directions that are perpendicular to the downstream surface of each burner element, as best shown in FIG. 4. The individual surface burner elements can be spaced apart sufficient to enable heat extraction from the surface burner gases. By placing the nozzles at a distance from the edges of the burner elements, relatively cooler gas can be entrained with the additional fuel jets, thereby reducing NOx generated in the burnout flames.

Figure 5:
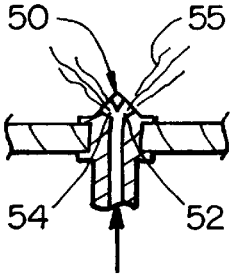
FIG. 5 is a fragmentary cross sectional view similar to FIG. 4 showing details of a nozzle for a fuel jet in accordance with another embodiment.

FIG. 5 illustrates another embodiment providing a modified secondary fuel jet nozzle 50 for use in the apparatus of FIG. 3 in the place of nozzles 44 and 46. The outlet end of nozzles 50 is formed with a tip that has one or more angled openings 52, 54 which direct the fuel jets 55 out at predetermined angles to the plane of each surface burner element. This enhances mixing of the additional fuel with surface combustion products from the primary combustion zone.

Figure 6:
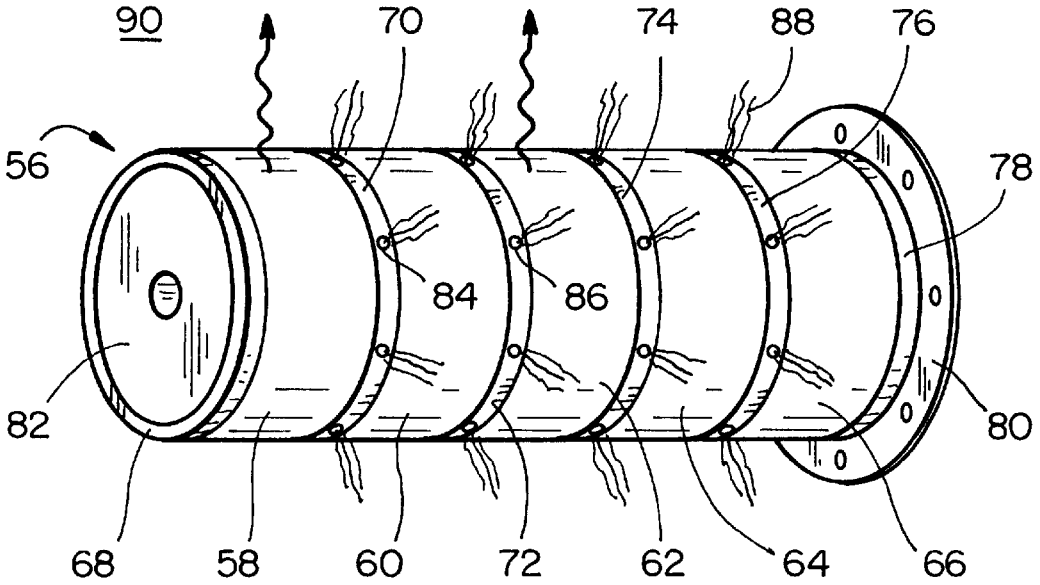
FIG. 6 is a perspective view of burner apparatus in accordance with another embodiment.

FIG. 6 illustrates another embodiment providing a cylindrical burner apparatus 56 comprising a plurality of annular surface burner elements 58–66 that are mounted together by a metal framework to form a cylindrical shell configuration. The framework comprises a plurality of axially spaced circular bands 68–78. Band 78 at the upstream end is mounted to a flange 80 which is adapted for mounting to the end wall, not shown, of the combustion chamber, such as in a boiler or other end use application. Band 68 at the downstream end is joined with a discshaped end plate 82, which can also comprise a surface burner element.

A plurality of nozzles 84, 86 are mounted in circumferentially spaced positions about each of the bands. A suitable manifold, not shown, connected with a supply of fuel is provided to direct additional fuel through the nozzles to create fuel jets 88 which are directed radially outwardly from the cylinder. These fuel jets mix with the combustion products from the surface burner element that move in an annular stream about apparatus 56 in a direction from right to left in FIG. 6. The secondary fuel then reacts with excess air from the combustion products in a secondary combustion zone 90 which begins around the burner apparatus and extends in a downstream direction.

Figure 7:
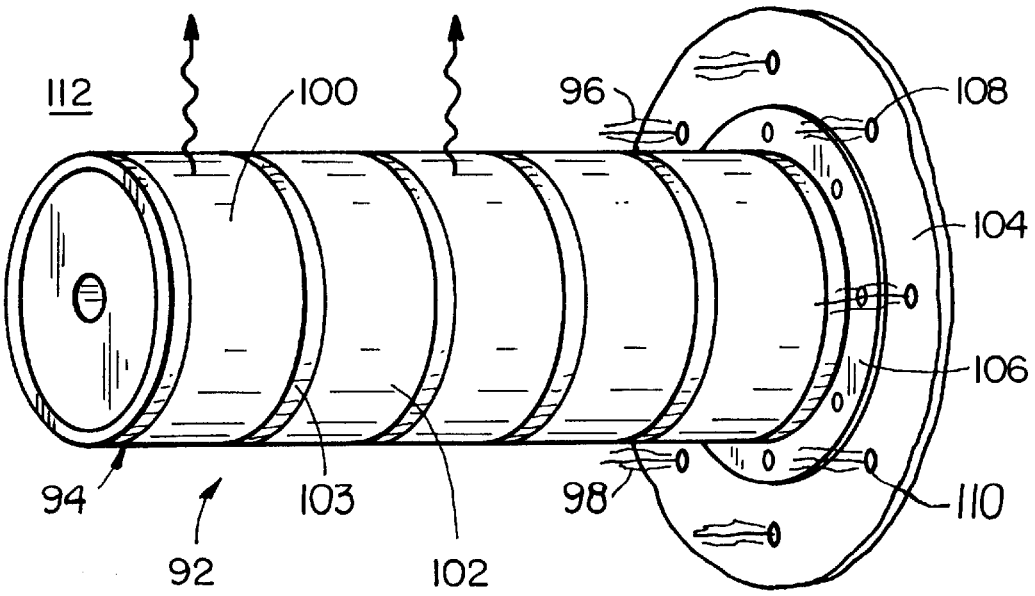
FIG. 7 is a perspective view of burner apparatus in accordance with another embodiment.

FIG. 7 illustrates another embodiment providing a combustion system 92 which incorporates a cylindrical burner apparatus 94 in combination with the injection of additional fuel jets 96, 98. The fuel jets are spaced outwardly from the burner cylinder which is formed by a plurality of annular surface burner elements 100, 102. The jets are directed parallel or at an angle to the cylinder. The framework of annular bands 103 which support the burner elements are not provided with additional fuel jet nozzles in this illustration, but could be provided with fuel jets. The end wall 104 of the combustion chamber to which cylinder flange 106 is mounted is provided with a plurality of nozzles 108, 110 in circumferentially spaced apart positioning about the axial centerline of the burner cylinder. The nozzles are connected with a fuel source, not shown, for injecting the secondary fuel jets into the combustion chamber in parallel streams or at angles to each other which are spaced about the outer periphery of the cylinder for mixing of the additional fuel with combustion products from the surface burner elements. This additional fuel reacts with excess air from the combustion in a secondary combustion zone 112 which begins around the burner cylinder and extends beyond the burner.

Figure 8:
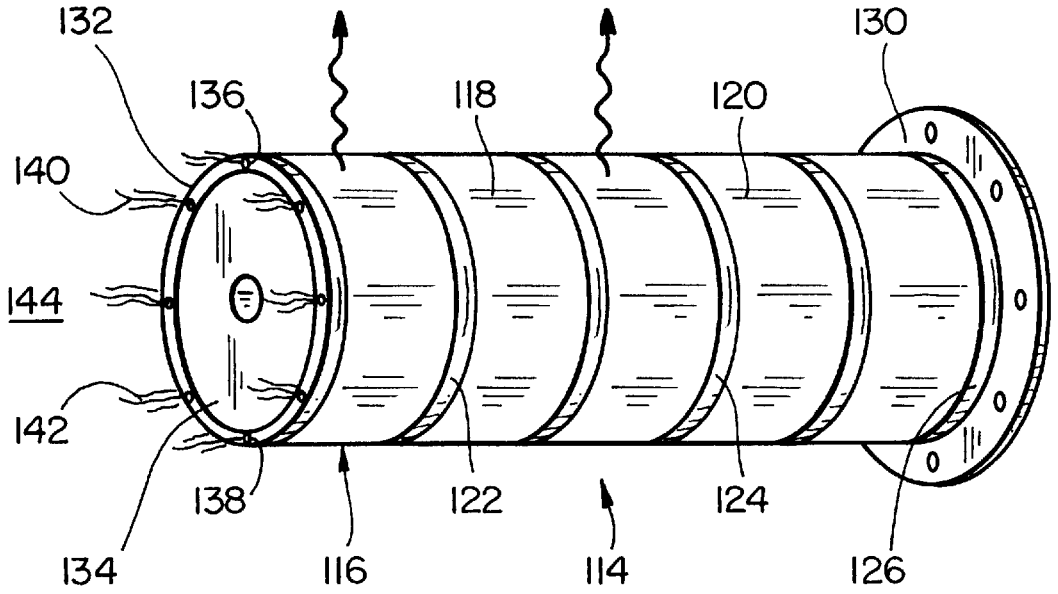
FIG. 8 is a perspective view of burner apparatus in accordance with another embodiment.

FIG. 8 illustrates another embodiment providing a combustion system 114 comprising a cylindrical burner apparatus 116 having a plurality of annular surface burner elements 118, 120. The burner elements are mounted in end-to-end relationship by a framework of metal bands 122, 124, 126 to form a burner of cylindrical shell configuration. The surface burner elements preferably are of the type described for the embodiment of FIG. 2. The band 126 at the upstream end of the burner is mounted to a flange 130 which is adapted for mounting on the end wall of the desired end-use combustion chamber, not shown. The bands 122–126 are not provided with fuel jet nozzles. A band 132 at the downstream end of the cylinder mounts a flat circular end plate 134 which serves to close off the inner volume of the cylinder. The end plate can also be comprised of a surface burner element for combusted fuel on its downstream surface. A plurality of nozzles 136, 138 are mounted at circumferentially spaced positions about end band 132. The nozzles are connected with a suitable manifold, not shown, with a fuel supply. The nozzles direct secondary fuel jets 140, 142 in a direction axially or at any angle relative to the cylinder.

The additional fuel from jets 140 and 142 mixes with the surface burner element combustion products which are directed by the walls of the combustion chamber in an annular stream which flows in parallel relationship about the burner cylinder from right to left as viewed in FIG. 8. The additional fuel reacts with excess air in the combustion products for burnout in a secondary combustion zone 144 which is located downstream of the end of the burner cylinder. This embodiment is particularly suited for firetube boilers or heaters where the burner is tightly confined and the furnace has a relatively small diameter-to-length aspect ratio with its exhaust exit at the end of the furnace which is opposite the burner. The direction of flow of the gases is primarily parallel with the burner axis.

Figure 9:
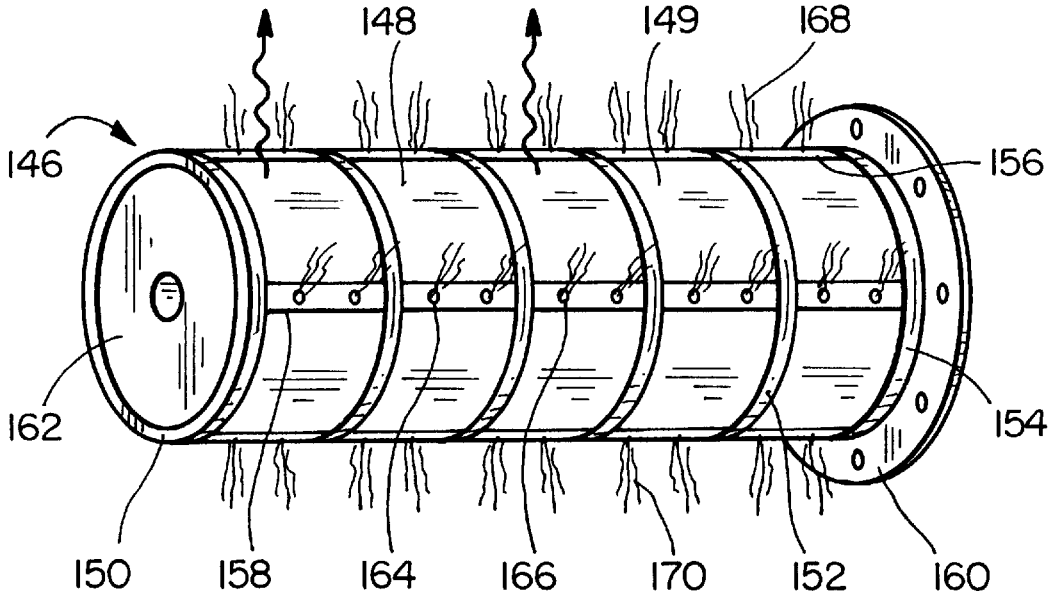
FIG. 9 is a perspective view of burner apparatus in accordance with another embodiment.

FIG. 9 illustrates another embodiment providing a cylindrical burner apparatus 146 which is comprised of a plurality of annular surface burner elements 148, 149 that are mounted in end-to-end relationship by means of a plurality of annular bands 150–154. The framework additionally includes a plurality, e.g. four, of elongate frame members 156, 158 which extend axially at 900 circumferentially spaced-apart relationship about the outer surface of the cylinder. Band 154 at the upstream end is mounted to a flange 160 which is adapted for mounting on the end wall of the combustion chamber, not shown. The band 150 at the downstream end of the cylinder mounts a circular end plate 162, which can also comprise a surface burner element.

A plurality of longitudinally spaced-apart nozzles 164, 166 are mounted along the length of each elongate frame member 156, 158. The nozzles are connected through a suitable manifold, not shown, with a fuel supply. The nozzles inject additional fuel jets 168, 170 radially outwardly from the sides of the cylinder. The surface burner combustion products are directed by the walls of the combustion chamber in an annular stream toward the downstream end of the cylinder. This annular stream moves at right angles to the direction at which the additional fuel jets are directed for mixing with the products of combustion from the primary combustion zone.

The embodiment of FIG. 9 is particularly suited for installations requiring field erection or package boilers or heaters where the exhaust exit is at the top of the system. The burner of this embodiment is not tightly confined such that the height-to-width or depth ratio is moderate and the overall gas flow is more perpendicular to the surface burner cylinder axis.

Figure 10:
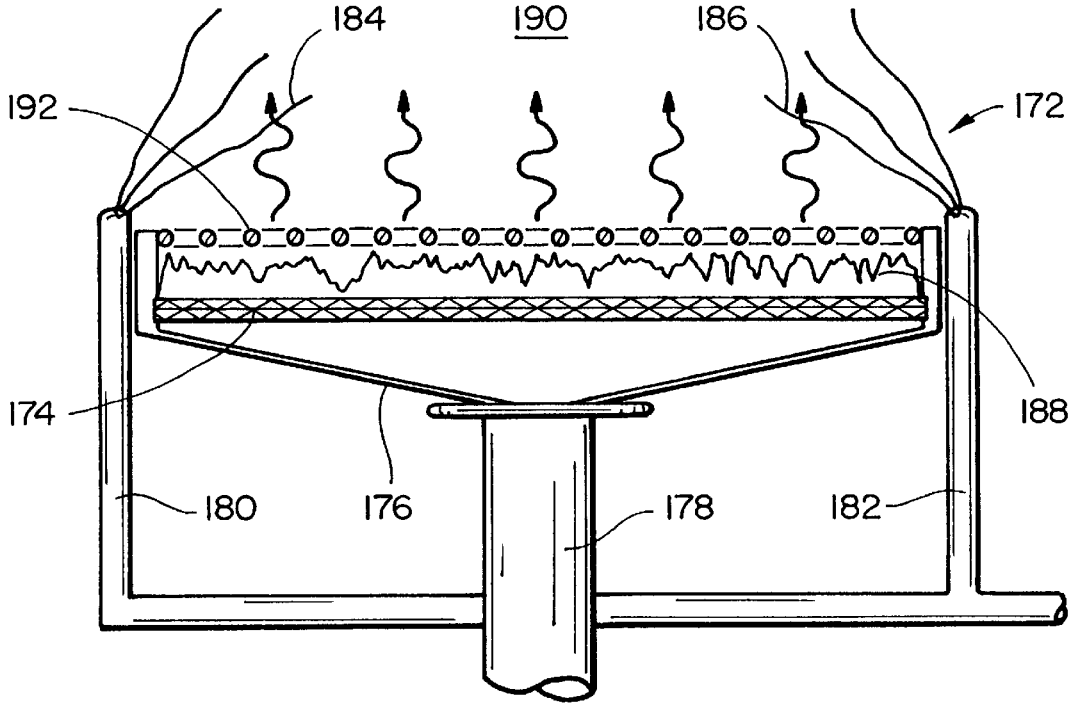
FIG. 10 is an axial section view of burner apparatus in accordance with another embodiment.

FIG. 10 illustrates another embodiment providing a burner 172 comprised of a surface burner element 174 of flat configuration mounted at the end of a shroud 176. The shroud directs the flow of premixed fuel and air from inlet tube 178 for distribution into and through the burner element. The primary flow of lean fuel and air is combusted on the downstream side of the burner element in the manner explained in connection with the embodiment of FIG. 2. A plurality of nozzles 180, 182 are connected with a manifold to a suitable fuel supply, not shown. The nozzles direct additional fuel jets 184, 186 at inwardly directed angles into the combustion products from primary combustion zone 188 above the surface of the burner element. The secondary fuel jets mix with the combustion products and react in a secondary combustion zone 190 with the excess air from the surface combustion products.

In the embodiment of FIG. 10 a metal radiant screen 192 is mounted in spaced relationship above the downstream side of burner element 174. The screen enhances the transfer of heat from the surface combustion products to an external load, not shown, such as boiler firetubes, prior to injection of the additional fuel.

Figure 11:
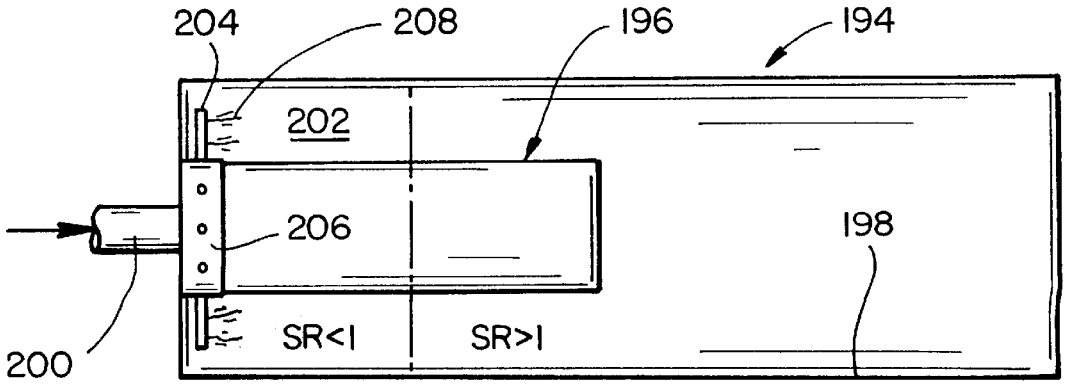
FIG. 11 is an axial section view of burner apparatus in accordance with another embodiment.

FIG. 11 illustrates burner apparatus 194 in accordance with another embodiment. Burner apparatus 194 includes a surface burner element 196 of cylindrical shell configuration mounted axially within the combustion chamber cylindrical wall 198, which can be a wall of a boiler firetube. A mixture of primary fuel and air is directed through an inlet 200 into the upstream end of the burner cylinder. This mixture is distributed radially outwardly to the outer surface of the burner element where combustion takes place in a primary combustion zone 202 about the outer surface of the cylinder. A plurality of additional fuel injectors 204 are mounted on a band 206 at the upstream end of the cylinder with the injectors extending radially outwardly about the periphery of the band. Additional fuel is directed through a manifold into the injectors, and one or more nozzles, not shown, carried by the injectors direct additional fuel jets 208 in a downstream direction axially about the burner cylinder.

With burner apparatus 194 the additional fuel is added near the upstream end of the burner cylinder and is burned in the annular gap between this cylinder and combustion chamber wall 198. Because the cylindrical surface burner element provides the oxygen needed for combustion of the injected fuel, a portion of the burning at the gap near injectors 204 occurs under fuel rich conditions. For high temperature conditions, this suppresses NOx by limiting oxygen availability. Given the reduced level of air dilution in this region, gas temperatures are high and radiative and conductive heat transfer to the wall is enhanced. Substantial heat is then lost from the combustion products. With the continued input of oxygen rich gases from the surface burner element, eventually the available oxygen in the gap exceeds the fuel requirement, and the portion of the burner downstream of this location operates with an excess of air. In this downstream location of the gap, all of the injected fuel is completely consumed and NOx is suppressed because of the prior heat transfer from the gas. The oxygen deficient region of the gas flow is shown in the figure by the region indicated with the stoichiometric ratio SR<1. The excess air region is indicated by the stoichiometric ratio SR>1.

Figure 12:
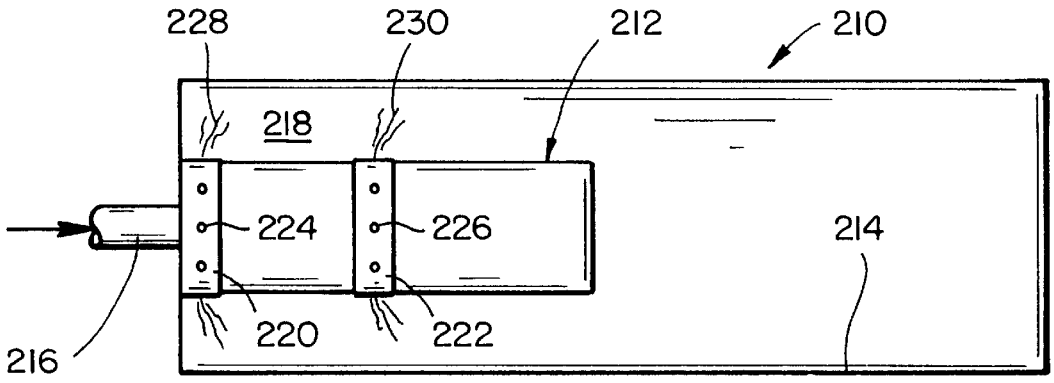
FIG. 12 is an axial section view of burner apparatus in accordance with another embodiment.

FIG. 12 illustrates burner apparatus 210 in accordance with another embodiment which comprises a surface burner element 212 of cylindrical shell configuration. The burner element is mounted axially within a combustion chamber wall 214 in the manner similar to that described for the embodiment of FIG. 11. A mixture of primary fuel and air from inlet 216 is directed into the upstream end of the cylinder for distribution to the outside of the surface element where it is combusted in a primary combustion zone 218. A pair of circular bands 220, 222 are mounted in axially spaced relationship along the cylinder, with band 220 at the upstream end and band 222 spaced at a predetermined location further downstream. A plurality of nozzles 224, 226 are provided at circumferentially spaced positions in each band. The nozzles are connected with a suitable manifold, not shown, with a fuel supply for directing additional fuel jets 228, 230 radially outwardly into the surface combustion products.

In the embodiment of FIG. 12, the addition of fuel at several locations axially along the length of the burner element suppresses excess air and also transfers heat between the fuel injection locations. With suppressed excess air, the NOx is suppressed. Furthermore, NOx produced in the upstream locations is mixed with fuel at subsequent fuel injection locations. The previously formed NOx is then reduced by reaction with the fuel. Essentially, the NOx becomes the oxidizer for the fuel. With the combination of NOx suppression and reduction, NOx at the exhaust is suppressed.

Figure 13:
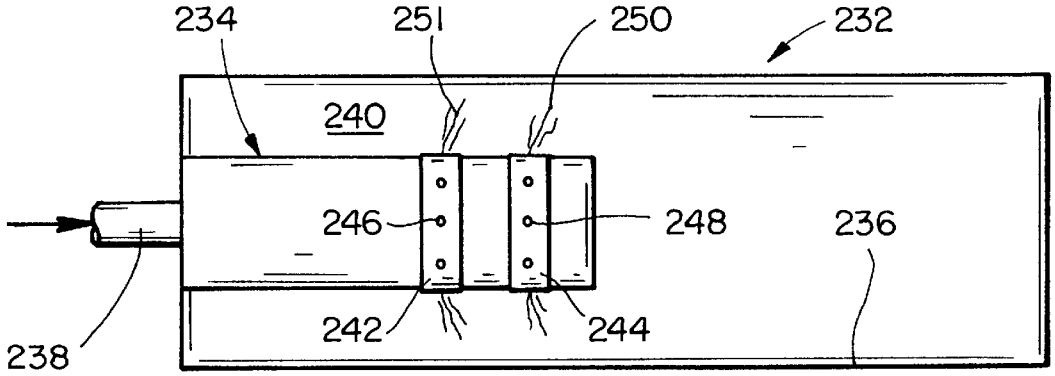
FIG. 13 is an axial section view of burner apparatus in accordance with another embodiment.

FIG. 13 illustrates burner apparatus 232 in accordance with another embodiment. Apparatus 232 comprises a surface burner element 234 of cylindrical shell configuration which is mounted axially within combustion chamber wall 236. A mixture of primary fuel and air is directed through inlet 238 into the inside of the burner element cylinder. The mixture is then distributed outwardly to the outer surface of the burner element where it combusts in a primary combustion zone 240. Near the downstream end of the cylinder a plurality of bands 242, 244 are mounted in axially spaced locations. The upstream band 242 is provided with a plurality of circumferentially spaced nozzles 246, which are connected with a manifold, not shown, and a source of pressurized air. The downstream band 244 is provided with a plurality of circumferentially spaced nozzles 248 which are connected with a manifold, also not shown, with a fuel supply.

The nozzles 248 inject secondary fuel jets 250 radially outwardly into the downstream flow of combustion products from the primary combustion zone. The nozzles 246 inject air jets 251 radially outwardly into the stream of combustion products upstream of the additional fuel injection location. When injected upstream of the fuel injection location, the extra air provides some mixing enhancement of the fuel which is injected at the end of the burner. The extra air could also be injected from nozzles, not shown, provided in band 244 at the same location of the fuel injection, and this arrangement would also provide mixing enhancement. The band 244 with the fuel injectors could also be located upstream of the air injector band, and in such case with the air injected downstream of the fuel injection there would also be mixing enhancement. The enhanced mixing in these three different arrangements reduces any unburned fuel components. In addition, as a result of the dilution of combustion products by the injected air, downstream gas temperatures are reduced. With this arrangement, fuel burnout as well as heat loads on the downstream chamber are enhanced. When the air is injected downstream of the fuel injector, the fuel jet initially burns with a deficiency of oxygen to suppress NOx formation. The injected air then mixes with the injected fuel and completes burnout. By using an excess amount of air, combustion products can be diluted, resulting in lower exit gas temperatures. This also reduces the heat load on the downstream chamber.

Figure 14:
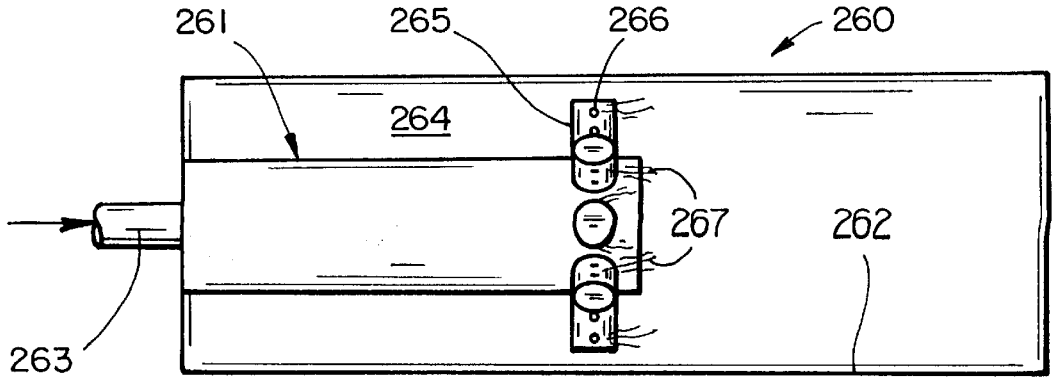
FIG. 14 is an axial section view of the burner apparatus in accordance with another embodiment.

FIG. 14 illustrates burner apparatus 260 in accordance with another embodiment. Apparatus 260 comprises a surface burner element 261 of cylindrical shell configuration which is mounted axially within combustion chamber wall 262. A mixture of primary fuel and air is directed through inlet 263 into the inside of the burner element cylinder. The mixture is then distributed outwardly to the outer surface of the burner element where it combusts in a primary combustion zone 264. Near the downstream end of the cylinder a plurality of bodies 265 protrude into the axial flow of primary combustion zone products. The bodies 265 are provided with a plurality of spaced nozzles 266, which are connected with a manifold, not shown, and a source of secondary fuel supply. The nozzles 266 inject secondary fuel jets 267 outwardly into the downstream flow of combustion products from the primary combustion zone. The bodies 265 protruding into the flow better distribute the secondary fuel 267 into the primary combustion zone products. In addition, the bodies 265 influence the downstream flowing product gas by creating turbulent eddies of up to the same scale as the bodies. These eddies act to rapidly mix the secondary fuel jets 267 with the primary combustion zone products across the chamber. With this arrangement both mixing on the scale of the bodies 265 and smaller scales are increased and the downstream distance required to burn out the secondary fuel is reduced. While cylindrical bodies 265 are illustrated in FIG. 14, rectangular, triangular, airfoil, vane, or other cross sectional body shapes could be utilized. Also, while eight bodies 265 are illustrated in FIG. 14, one or many bodies could be incorporated into the burner to accomplish fuel injection and mixing needs. Also, secondary fuel injectors 266 could be located on the main cylindrical burner 261 in which case the bodies 265 would not have secondary fuel nozzles and would be utilized only for turbulent mixing enhancement.

It is apparent from the foregoing that the present invention provides an improved combustion process and burner apparatus employing the surface burner with lean premixed combustion occurring near the surface at low temperature and thereby low NOx. With the mixed state of the lean fuel and air, surface mediated combustion proceeds with minimal NOx, CO and unburned hydrocarbon emissions. Temperatures of the surface combustion products are reduced by: a) heat transfer either to the burner surface element as in the embodiment of FIGS. 3 and 4, and/or to elements above the surface disposed within the combustion gases such as in the embodiment of FIG. 2, and 10 and; b) radiation or active cooling of the surface or elements above the surface to a load, and/or d) mixing the products with cooled furnace gas. The lower temperature product gas can be entrained into a multiplicity of secondary fuel jets that are directed either perpendicular, or at an angle, to the surface element. The secondary fuel jets can also entrain some cooled furnace gas, as in the embodiment of FIG. 2. This additional fuel is then burned at a reduced temperature relative to combustion with air. This suppresses NOx. Fuel in these jets increases the overall burner heat release and reduces excess air to conventional burner levels.

Other advantages from the combustion process and burner apparatus of the invention include reduced flashback and therefore increased safety; increased turndown capability; air preheat capability; durability; liftoff; and reduced costs.

In the invention, the type of surface element, the level of excess air and the firing rate per burner surface area determine the properties of the surface element combustion products. The location, number, diameter and orientation of the secondary fuel jets determine the rate of mixing with the surface element product gases, and thereby determine the combustion rate above the surface. By varying parameters of the burner surface element and the secondary fuel jets, both compact and long combustion zones for their various properties, can be achieved. Thus, the burner of the invention can be configured in many different ways to cover a variety of different heat release rates of practical interest. In the invention, sufficient fuel can be added through the secondary jets to reduce high excess air in the combustion products from the surface burner flame.

A burner apparatus constructed in accordance with the embodiment of FIG. 10 was tested at a firing rate of 270,000 Btu/hr $ft^2$. NOx levels below 9 ppm were achieved at 10% excess air, or higher, with 35% of the total fuel in the secondary fuel injectors. These NOx levels are over 80% lower than that produced by a conventional surface burner. In all cases CO was below 40 ppm. In these tests, effects of entrainment of the furnace gas into the secondary jets and surface radiation on NOx were examined. The rate of the furnace gas entrainment into secondary jets was increased by moving secondary fuel jets away from the surface burner. The rate of radiating heat loss was increased by adding screens downstream of the surface burner. By adding screens, radiating surface area and the radiating heat loss was increased.

Figure 15:
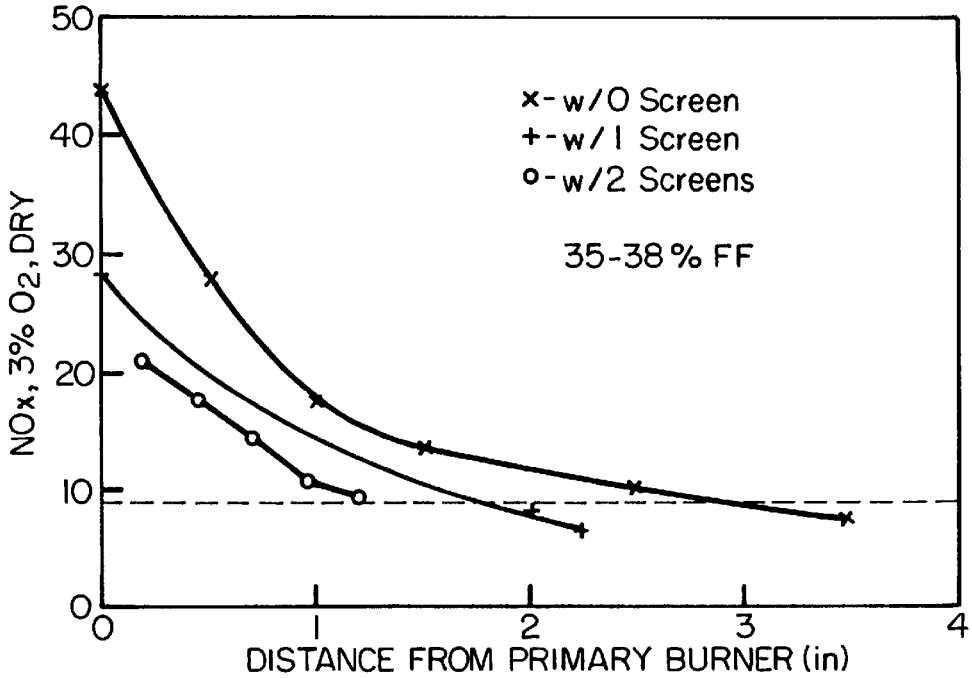
FIG. 15 is a graph which plots small-scale burner apparatus data that shows the impact of reverbatory screens and secondary fuel jet placement on NOx emission
Figure 16:
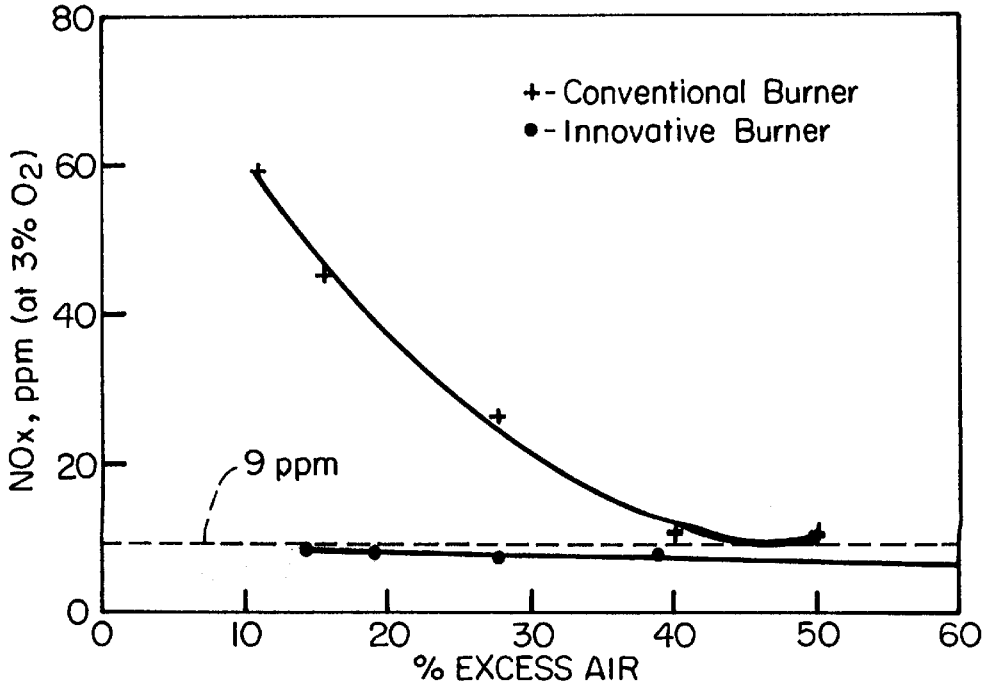
FIG. 16 is a graph which plots small-scale burner apparatus data that shows the NOx benefit of the burner over a conventional surface burner for a range of excess air levels.

The graph of FIG. 15 shows the test results for no screen, one, and two screens. As shown, by adding screens then the distance the jets must be spaced away from the surface burner to achieve the same NOx level (e.g. 9 ppm) was reduced. These test data show that the burner performance is flexible. Depending on the application, the position of the secondary jets can be varied. As an example, in a firetube application the fuel jets can even be added downstream of the burner, rather than integrated into the burner, as illustrated in FIG. 8. An important element of the invention is to minimize the NOx production in the secondary jets, by controlling peak flame temperature through heat extraction or dilution. FIG. 15 data shows that this can be achieved by furnace gas entrainment, by surface radiation, or by a combination of the two. This flexibility of the invention to achieve low NOx is an important advantage. Advantages of burners in accordance with the invention can be illustrated by comparing NOx results with those from a conventional AcoTech™ fiber surface burner, tested in the same test facility and under the same operating conditions. FIG. 16 presents the test results. To characterize the effect of excess air on NOx, tests were performed with the twoscreen burner. For these tests, fuel jets were set at 1 in distance from the burner edge. All data were obtained at the same firing rate. As shown, the innovative burner produces less than 9 ppm NOx for all excess air levels. In contrast, under low excess air conditions, the AcoTech™ burner produces substantially higher NOx. Therefore, if low NOx is required with the conventional surface burner, it has to be operated at high excess air, where efficiency is reduced. The innovative burner does not have this limitation and can operate efficiently while controlling NOx to low levels.

Figure 17:
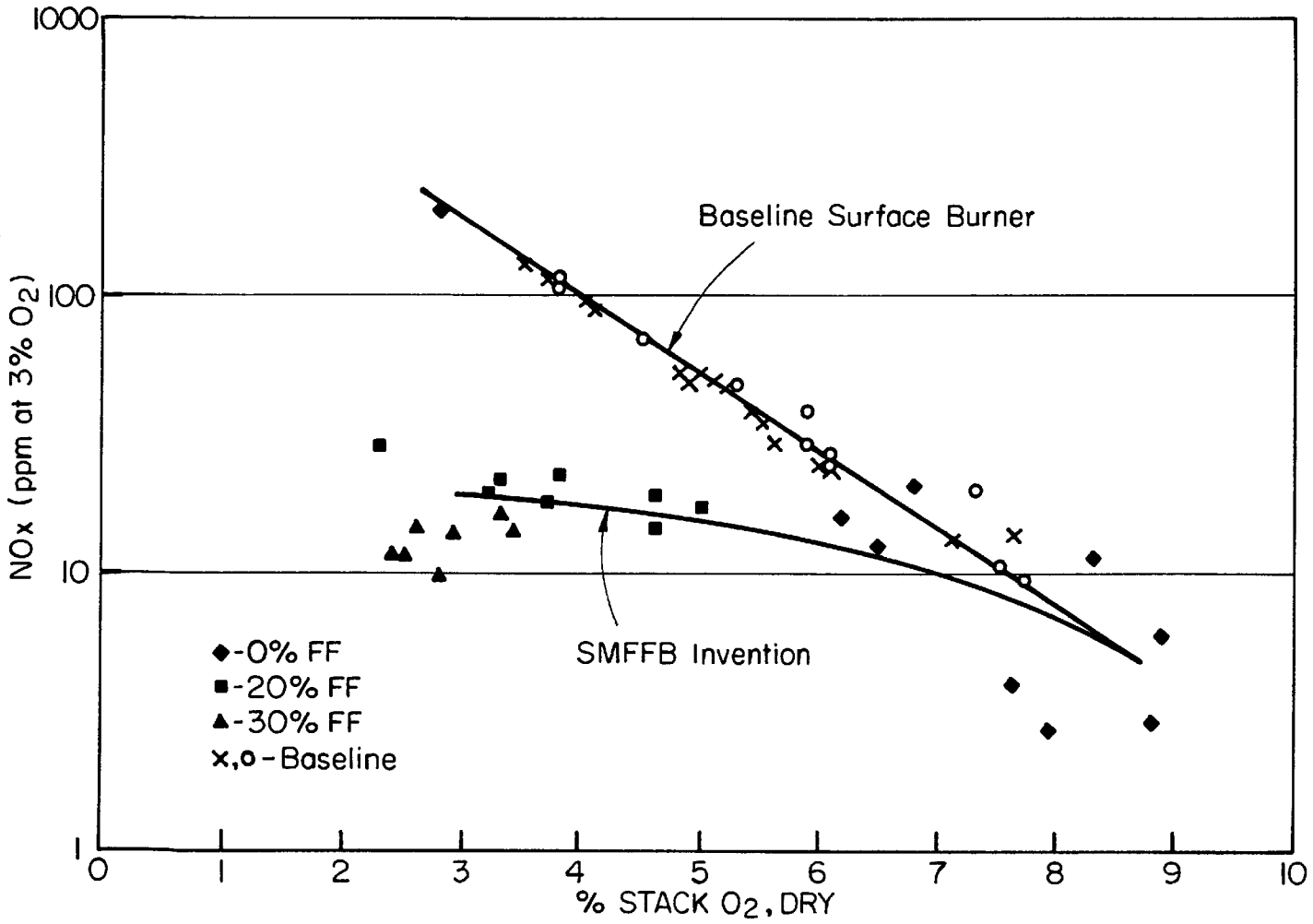
FIG. 17 is a graph which plots of a full-scale burner apparatus data that shows the NOx benefit of the burner over a baseline surface burner for a range of stack $O_2$ levels.

In addition to small-scale tests, the innovative burner was demonstrated at large scale. In these tests, the embodiment of FIG. 8 was tested in a 43 MMBtu/hr steam boiler and at a surface firing rate of 1 MM Btu/hr $ft^2$. In these tests, which were run jointly with Alzeta Corporation, of Santa Clara, Alzeta's CSB™ burner (U.S. Pat. No. 5,439,372) was used as the surface burner. Secondary jets were positioned at the end of the burner. Three jet configurations were tested: 1) Radial, e.g. normal to axis, 2) 45 degrees to axis and 3) 30 degrees to the axis. FIG. 17 shows the test results for different excess air and fuel fractions. The same figure shows the base surface burner NOx. As shown at 3% stack $O_2$, where the system efficiency is high, the innovative burner produces 10 to 30 ppm NOx, with lower NOx associated with higher secondary fuel input. All CO levels were below 80 ppm. At the same efficient low excess air condition, the base CSB™ surface burner produced 220 ppm. These tests demonstrate that, consistent with laboratory tests, a burner in accordance with the present invention can reduce NOx by over 80% relative to a conventional surface burner.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A combustion process for controlling NOx emissions, comprising: passing a mixture of primary fuel and air, in which the mixture has an excess portion of air which exceeds the stoichiometric requirement, to a surface burner element, distributing the mixture over the downstream side of the surface burner element, combusting the mixture on said downstream side in a primary combustion zone to produce surface combustion products and heat together with the excess portion of air, mixing secondary fuel with the surface combustion products, combusting in a secondary combustion zone the secondary fuel with the excess portion of air in the surface combustion products, and mixing cooled combustion products with said secondary fuel prior to the step of combusting the mixture in the secondary combustion zone.

2. A combustion process for controlling NOx emissions, comprising: passing a mixture of primary fuel and air, in which the mixture has an excess portion of air which exceeds the stoichiometric requirement, to a surface burner element, distributing the mixture over the downstream side of the surface burner element, combusting the mixture on said downstream side in a primary combustion zone to produce surface combustion products and heat together with the excess portion of air, mixing secondary fuel with the surface combustion products, combusting in a secondary combustion zone the secondary fuel with the excess portion of air in the surface combustion products and then mixing combustion products from the secondary combustion zone with said surface combustion products to form an additional mixture of combustion products, and combining said additional mixture of combustion products with said mixture of secondary fuel and air prior to the step of combustion in the secondary combustion zone.

3. A burner apparatus comprising a surface burner element having a surface for supporting combustion in a primary combustion zone, means for directing a lean mixture of primary fuel and air through the surface burner element for combustion in the primary zone to produce a downstream flow of surface combustion products includes heat and excess air, means for injecting secondary fuel into the downstream flow of surface combustion products from the first combustion zone for combustion of the secondary fuel and excess air in a second combustion zone, and means for extracting heat from the first and second combustion zones to produce cooled furnace gases, and said means for injecting secondary fuel comprises a plurality of fuel jets which are positioned from the surface burner elements at a distance which is sufficient to enable entrainment of the cooled furnace gases into the fuel jets prior to mixing of the fuel jets with said surface combustion products.

4. A burner apparatus comprising a surface burner element having a surface for supporting combustion in a primary combustion zone, means for directing a lean mixture of primary fuel and air through the surface burner element for combustion in the primary zone to produce a downstream flow of surface combustion products includes heat and excess air, means for injecting secondary fuel into the downstream flow of surface combustion products from the first combustion zone for combustion of the secondary fuel and excess air in a second combustion zone, said surface burner element is in the shape of a cylinder, said means for injecting secondary fuel comprises a plurality of fuel jets which are arranged on the outside of the cylinder and oriented for directing the secondary fuel into the surface products of combustion, means for extracting heat from the first and second combustion zones and to produce cooled furnace gases, and said fuel jets are positioned from the surface burner element at a predetermined distance which is sufficient to enable entrainment of the cooled furnace gases into the fuel jets.

5. A burner apparatus comprising a surface burner element having a surface for supporting combustion in a primary combustion zone, means for directing a lean mixture of primary fuel and air through the surface burner element for combustion in the primary zone to produce a downstream flow of surface combustion products including heat and excess air, means for injecting secondary fuel into the downstream flow of surface combustion products from the first combustion zone for combustion of the secondary fuel and excess air in a second combustion zone, in which the surface burner element is in the shape of a cylinder, said means for injecting secondary fuel comprises a plurality of fuel jets which are arranged on the outside of the cylinder and oriented for directing the secondary fuel into the surface products of combustion and means for extracting heat from the first and second combustion zones and to produce cooled furnace gases, means for injecting secondary fuel in a stream along a path which is outside the cylinder and directed toward the downstream end of the surface burner element for mixing of the secondary fuel with said surface products of combustion to cause the overall fuel and air ratio in the stream to change from rich to lean at a zone which is prior to the downstream end of the surface burner element, said last-mentioned means injects the secondary fuel at a plurality of locations which are axially spaced along the surface burner element.

6. A burner apparatus comprising a surface burner element having a surface for supporting combustion in a primary combustion zone, means for directing a lean mixture of primary fuel and air through the surface burner element for combustion in the primary zone to produce a downstream flow of surface combustion products including heat and excess air, means for injecting secondary fuel into the downstream flow of surface combustion products from the first combustion zone for combustion of the secondary fuel and excess air in a second combustion zone, in which the surface burner element is in the shape of a cylinder, said means for injecting secondary fuel comprises a plurality of fuel jets which are arranged on the outside of the cylinder and oriented for directing the secondary fuel into the surface products of combustion, means for extracting heat from the first and second combustion zones and to produce cooled furnace gases, said fuel jets are positioned from the surface burner element at a predetermined distance which is sufficient to enable entrainment of the cooled furnace gases into the fuel jets, and including at least one body mounted in the flow of primary combustion zone products, and said fuel jets are positioned on the body.

7. A combustion process for controlling NOx emissions, comprising: passing a mixture of primary fuel and air, in which the mixture has an excess portion of air which exceeds the stoichiometric requirement, to a surface burner element having a downstream side, distributing the mixture over the downstream side of the surface burner element, combusting the mixture on said downstream side in a primary combustion zone to produce surface combustion products including heat together with the excess portion of air, mixing secondary fuel with the surface combustion products, combusting in a secondary combustion zone the secondary fuel with the excess portion of air in the surface combustion products, transferring heat from the primary combustion zone to the surface burner element, and transferring heat from the surface burner element to a load.

8. A combustion process for controlling NOx emissions, comprising: passing a mixture of primary fuel and air, in which the mixture has an excess portion of air which exceeds the stoichiometric requirement, to a surface burner element having a downstream side, distributing the mixture over the downstream side of the surface burner element, combusting the mixture on said downstream side in a primary combustion zone to produce surface combustion products including heat together with the excess portion of air, mixing secondary fuel with the surface combustion products, combusting in a secondary combustion zone the secondary fuel with the excess portion of air in the surface combustion products, transferring heat from the primary combustion zone to the heat sink, and transferring heat from the heat sink to a load.

9. A combustion process for controlling NOx emissions, comprising: passing a mixture of primary fuel and air, in which the mixture has an excess portion of air which exceeds the stoichiometric requirement, to a surface burner element having a downstream side, distributing the mixture over the downstream side of the surface burner element, combusting the mixture on said downstream side in a primary combustion zone to produce surface combustion products including heat together with the excess portion of air, mixing secondary fuel with the surface combustion products, combusting in a secondary combustion zone the secondary fuel with the excess portion of air in the surface combustion products, and mixing cooled combustion products with said mixture of primary fuel and air prior to the step of combusting the mixture in the primary combustion zone.

10. A process as in claim 7 including the step of mixing secondary air with the secondary fuel.

11. A burner apparatus as in claim 3 in which said surface burner element comprises passageways for distributing the mixture of primary fuel and air from an upstream side of the element into a surface mediated flame on the downstream side of the element.

12. Apparatus as in claim 11 in which said downstream side of the surface burner element has a given surface area, and the ratio of said given surface area to the throughput rate of said mixture of primary fuel and air through the surface burner element is sufficient to cause heat from the surface mediated flame to transfer back to the element and then to an external load.

13. Apparatus as in claim 3 in which said means for injecting secondary fuel comprises means for mixing a gas with the secondary fuel prior to said injection.

14. Apparatus as in claim 3 which includes means for mixing a gas with the fuel prior to said step of injecting the lean mixture through the surface burner element.

15. Apparatus as in claim 13 in which said gas is selected from the group consisting of air, flue gas and steam.

16. Apparatus as in claim 14 in which said gas is selected from the group consisting of flue gas and steam.

17. Apparatus as in claim 3 including a heat sink in the primary combustion zone to extract heat from and reduce the temperature of said surface combustion products prior to said mixing of the fuel jets with the surface combustion products.

18. Apparatus as in claim 4 in which said fuel jets are positioned on an end of the cylinder which is the downstream end of the surface burner element.

19. Apparatus as in claim 4 in which said fuel jets are positioned on the outer periphery of the cylinder.

20. Apparatus as in claim 4 in which said fuel jets are positioned in spaced-apart relationship longitudinally of the cylinder.

21. Apparatus as in claim 4 which includes a heat sink spaced radially outwardly from the cylinder to extract heat from the primary combustion zone prior to injection of the secondary fuel into the products of combustion.

22. Apparatus as in claim 4 in which said surface burner element comprises a heat sink which has a given surface area, and the ratio of the given surface area to the throughput rate of the mixture of primary fuel and air is sufficient to cause heat from the primary combustion zone to transfer away back to the heat sink and then transfer away from the heat sink.

23. Apparatus as in claim 4 in which said plurality of fuel jets inject the secondary fuel in a stream along a path which is outside the cylinder and directed toward the downstream end of the surface burner element for mixing of the secondary fuel with said surface products of combustion to cause the overall fuel and air ratio in the stream to change from rich to lean at a zone which is prior to the downstream end of the surface burner element.

24. Apparatus as in claim 4 which includes means for supplying secondary air into the surface products of combustion at a rate which is sufficient to increase the oxygen content of gases within the surface products of combustion.

25. Apparatus as in claim 4 which includes at least one body mounted in the flow of primary combusion zone products.

* * * * *